US011702613B2

(12) United States Patent
Kochi et al.

(10) Patent No.: US 11,702,613 B2
(45) Date of Patent: Jul. 18, 2023

(54) GREASE COMPOSITION FOR BALL JOINT

(71) Applicant: Kyodo Yushi Co., Ltd., Fujisawa (JP)

(72) Inventors: Tsuyoshi Kochi, Tokyo (JP); Mitsuhiro Kakizaki, Chigasaki (JP); Yosuke Fujiwara, Hamamatsu (JP); Tomohiro Monna, Hamamatsu (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 16/074,821

(22) PCT Filed: Feb. 27, 2017

(86) PCT No.: PCT/JP2017/007553
§ 371 (c)(1),
(2) Date: Aug. 2, 2018

(87) PCT Pub. No.: WO2017/146257
PCT Pub. Date: Aug. 31, 2017

(65) Prior Publication Data

US 2020/0181528 A1 Jun. 11, 2020

(30) Foreign Application Priority Data

Feb. 26, 2016 (JP) ..... 2016-035946

(51) Int. Cl.
*C10M 169/04* (2006.01)
*C10M 107/04* (2006.01)
(Continued)

(52) U.S. Cl.
CPC ..... *C10M 169/044* (2013.01); *C10M 107/04* (2013.01); *C10M 107/10* (2013.01);
(Continued)

(58) Field of Classification Search
CPC ..... C10M 169/044; C10M 133/42; C10M 107/10; C10M 133/16; C10M 159/08;
(Continued)

(56) References Cited

U.S. PATENT DOCUMENTS

2004/0198617 A1 10/2004 Kinoshita et al.
2007/0149422 A1 6/2007 Miyajima et al.
(Continued)

FOREIGN PATENT DOCUMENTS

CN 1771316 A 5/2006
CN 102134523 A 7/2011
(Continued)

OTHER PUBLICATIONS

International Search Report (PCT/ISA/210) dated Apr. 4, 2017, by the Japanese Patent Office as the International Searching Authority for International Application No. PCT/JP2017/007553.
(Continued)

*Primary Examiner* — Taiwo Oladapo
(74) *Attorney, Agent, or Firm* — Buchanan Ingersoll & Rooney PC

(57) ABSTRACT

Provided is a grease composition for a ball joint that can reduce the wear of a ball seat at a slide region and also has excellent compatibility with a dust cover. The grease composition for a ball joint comprises a base oil, a thickener, and an additive. The base oil contains an ethylene-α-olefin copolymer and the kinetic viscosity of the base oil at 40° C. is 2,000 to 6,000 $mm^2/s$. The additive contains a polar wax (e.g., monoamide wax or ester wax).

6 Claims, 1 Drawing Sheet

(51) Int. Cl.

| | |
|---|---|
| ***C10M 107/10*** | (2006.01) |
| ***C10M 133/16*** | (2006.01) |
| ***C10M 133/42*** | (2006.01) |
| ***C10M 147/02*** | (2006.01) |
| ***C10M 159/06*** | (2006.01) |
| ***C10M 159/08*** | (2006.01) |
| ***C10M 169/02*** | (2006.01) |
| *C10N 20/02* | (2006.01) |

(52) U.S. Cl.
CPC ..... *C10M 133/16* (2013.01); *C10M 133/42* (2013.01); *C10M 147/02* (2013.01); *C10M 159/06* (2013.01); *C10M 159/08* (2013.01); *C10M 169/02* (2013.01); *C10M 2205/0225* (2013.01); *C10M 2205/0285* (2013.01); *C10M 2213/062* (2013.01); *C10M 2215/06* (2013.01); *C10M 2215/08* (2013.01); *C10M 2215/102* (2013.01); *C10M 2215/222* (2013.01); *C10N 2020/02* (2013.01)

(58) Field of Classification Search
CPC ..... C10M 107/04; C10M 147/02; C10M 169/02; C10M 159/06; C10M 2205/0285; C10M 2215/06; C10M 2213/062; C10M 2215/222; C10M 2205/0225; C10M 2215/08; C10M 2215/102; C10N 2220/022; C10N 2020/02

See application file for complete search history.

(56) References Cited

U.S. PATENT DOCUMENTS

| | | | | |
|---|---|---|---|---|
| 2007/0265179 | A1 | 11/2007 | Kinoshita et al. | |
| 2010/0105585 | A1* | 4/2010 | Carey | C10M 141/10 508/162 |
| 2011/0318092 | A1 | 12/2011 | Kinoshita et al. | |
| 2015/0024980 | A1 | 1/2015 | Arai et al. | |
| 2015/0191674 | A1* | 7/2015 | Goto | C10M 169/044 285/94 |
| 2016/0265589 | A1* | 9/2016 | Hino | F16C 33/104 |

FOREIGN PATENT DOCUMENTS

| | | | | |
|---|---|---|---|---|
| CN | 104145011 | A | | 11/2014 |
| JP | H01-308497 | A | | 12/1989 |
| JP | 6240274 | A | | 8/1994 |
| JP | 2003020492 | A | | 1/2003 |
| JP | 200689575 | A | * | 4/2006 |
| JP | 2006089575 | A | | 4/2006 |
| JP | 4199109 | B2 | | 12/2008 |
| JP | 2013181154 | A | | 9/2013 |
| WO | 03006590 | A1 | | 1/2003 |

OTHER PUBLICATIONS

Written Opinion (PCT/ISA/237) dated Apr. 4, 2017, by the Japanese Patent Office as the International Searching Authority for International Application No. PCT/JP2017/007553.

First Office Action dated Feb. 26, 2021, by the State Intellectual Property Office of People's Republic of China in corresponding Chinese Patent Application No. 201780013558.5 and an English translation of the Action. (13 pages).

* cited by examiner

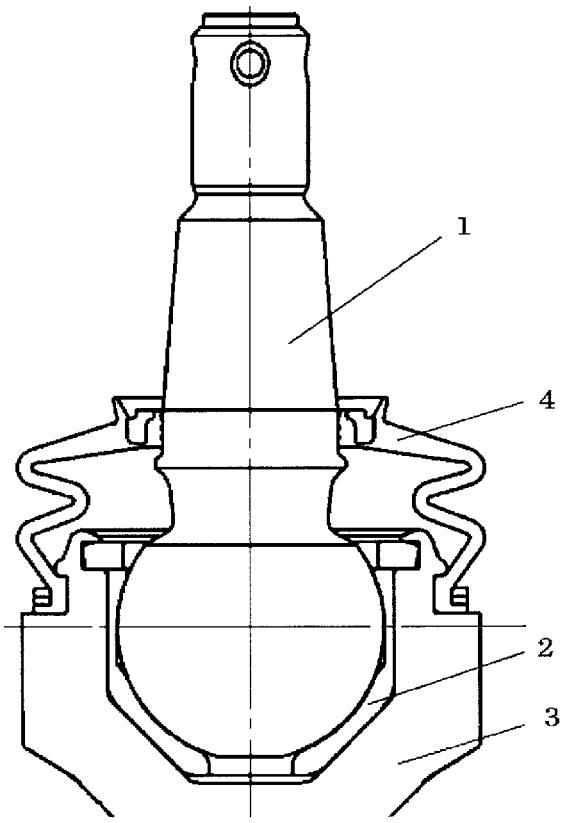
1
4
2
3

GREASE COMPOSITION FOR BALL JOINT

TECHNICAL FIELD

The present invention relates to a grease composition for a ball joint.

BACKGROUND ART

Ball joints are components that serve as joints and used, for example, in automobiles for the steering device for changing the direction of the vehicle, the suspension devices for supporting the vehicle body, and other link components.

FIG. 1 illustrates a cross section of a representative structure of a ball joint. The ball joint includes: a ball stud 1 having a stud portion extending in the axial direction and a ball portion joined to the stud portion in the axial direction through a thinner portion; a ball seat 2 holding the ball portion of the ball stud rotatably and swingably; a tubular case 3 with a closed bottom housing the ball seat; and a dust cover 4 mounted on a cover groove around the opening end of the case.

As the ball portion of the ball joint slides, the ball seat 2 wears gradually. For this reason, a grease composition is applied to the slide region. This grease composition is demanded to be a grease composition with which the wear of the ball seat is small.

The dust cover 4 is provided to prevent entrance of dust, muddy water, and the like from outside, and the grease composition is sealed therein. Here, depending on the type of the grease composition sealed, the dust cover may swell or shrink and break. If the dust cover breaks, foreign matters such as dust and muddy water from outside will enter the slide region. For this reason, there is a demand for a grease composition having excellent compatibility with the dust cover.

In recent years, the size of ball joints has been decreased and the surface pressure at the slide region has been increased. Thus, the requirements imposed on lubricity are stricter than the requirements on the lubricity of conventional grease compositions. Also, in addition to the excellent lubricity, it is also necessary to satisfy other general characteristics such as the compatibility with the dust cover.

As a conventional lubricant composition for a ball joint, Patent Literature 1 (Japanese Patent Application Laid-open No. Hei 6-240274), for example, describes a lubricant composition for a ball joint containing 50% by weight or more of a fatty acid salt in a base oil or a wax, the fatty acid salt being obtained by adding a particular polymerized fatty acid and oleic acid to a particular amide-amine compound. This lubricant composition is described as having a characteristic (frequency characteristic) that lowers the initial operation torque and suppresses the fluttering phenomenon during high-speed travel (paragraph [0010]). However, this lubricant composition cannot sufficiently satisfy the lubricity and the compatibility with a dust cover.

Also, Patent Literature 2 (Japanese Patent No. 4199109) describes a lubricant composition for a ball joint containing: a base oil containing a synthetic hydrocarbon oil; a thickener; and a particular fatty acid salt represented $R^1$—NH—$R^2$—$N_2$. This lubricant composition is described as exhibiting excellent low-friction performance at low and high temperatures in addition to low-friction performance at room temperature (paragraph [0022]). However, this lubricant composition can neither sufficiently satisfy the lubricity and the compatibility with a dust cover.

CITATION LIST

Patent Literatures

Patent Literature 1: Japanese Patent Application Laid-open No. Hei 6-240274

Patent Literature 2: Japanese Patent No. 4199109

SUMMARY OF INVENTION

Problem to be Solved by the Invention

An object of the present invention is to provide a grease composition that can reduce the wear of a ball seat at a slide region and also has excellent compatibility with a dust cover.

Means for Solution of the Problem

The present inventors have made studies earnestly and have found that the above problem can be solved by a grease composition with a selected type and kinetic viscosity of base oil and a selected type of additive. As a result, the present inventors have completed the present invention.

Specifically, the present invention is summarized as below.

(1) A grease composition for a ball joint comprising:

a base oil;

a thickener; and an additive, wherein the base oil contains an ethylene-α-olefin copolymer and kinetic viscosity of the base oil at 40° C. is 2,000 to 6,000 $mm^2/s$, and the additive contains a polar wax.

(2) The grease composition according to (1), wherein the polar wax is at least one selected from a monoamide wax and an ester wax.

(3) The grease composition according to (1) or (2), wherein the polar wax is at least one selected from stearic acid amide and hydrogenated castor oil.

(4) The grease composition according to any one of (1) to (3), wherein kinetic viscosity of the ethylene-α-olefin copolymer at 40° C. is 2,000 to 40,000 $mm^2/s$.

(5) The grease composition according to any one of (1) to (4), wherein content of the ethylene-α-olefin copolymer is 70% by mass or more based on a total amount of the base oil.

(6) The grease composition according to any one of (1) to (5), wherein content of the polar wax is 1 to 20% by mass based on a total amount of the grease composition.

(7) The grease composition according to any one of (1) to (6), wherein the additive further contains at least one solid lubricant selected from polytetrafluoroethylene and melamine cyanurate.

Advantageous Effects of Invention

The grease composition of the present invention is superior to conventional grease compositions in lubricity (resin lubricity) between a ball stud and a ball seat (e.g., a resin ball seat). Also, in addition to the above lubricity, the grease composition of the present invention can simultaneously satisfy other characteristics such as the compatibility with a dust cover, the low-torque performance at low temperature, and the frequency dependency as well.

BRIEF DESCRIPTION OF DRAWING

FIG. 1 is a cross-sectional view illustrating a representative structure of a ball joint.

DESCRIPTION OF EMBODIMENT

[Grease Composition for Ball Joint]

A grease composition for a ball joint of the present invention contains a base oil, a thickener, and an additive. Each component will be described below.

(Base Oil)

In the present invention, in view of improving the lubricity for a ball joint by reducing the wear of its ball seat (resin or elastomer member) due to sliding of its ball stud (metal member) and the ball seat (resin or elastomer member) relative to each other, the base oil contains at least an ethylene-α-olefin copolymer. By using the ethylene-α-olefin copolymer, the low-torque performance at low temperature will be excellent. Also, with the ethylene-α-olefin copolymer, the frequency dependency can be satisfied as well. The ethylene-α-olefin copolymer is preferred as the base oil of a grease composition to be sealed in a ball joint for an automobile.

The ethylene-α-olefin copolymer is not particularly limited as long as it is a copolymer of ethylene and an α-olefin with three or more carbon atoms. Examples of the α-olefin include linear and branched α-olefins such as octene, decene, and dodecane. One of these α-olefins may be used or two or more of them may be used in combination with each other.

The kinetic viscosity of the ethylene-α-olefin copolymer at 40° C. is not particularly limited but is selectable from the range of 2,000 to 40,000 $mm^2/s$, for example, and is preferably 3,000 to 35,000 $mm^2/s$ (e.g., 4,000 to 30,000 $mm^2/s$), more preferably 5,000 to 25,000 $mm^2/s$ (e.g., 6,000 to 20,000 $mm^2/s$), and particularly preferably 7,000 to 17,000 $mm^2/s$ (e.g., 9,850 to 15,000 $mm^2/s$). With the kinetic viscosity of the ethylene-α-olefin copolymer at 40° C. within the above range, not only the lubricity but also the low-torque performance at low temperature can be improved. Note that the kinetic viscosity at 40° C. is measured by a method complying with JIS K 2283.

The base oil may be made of the ethylene-α-olefin copolymer alone or made of a combination of the ethylene-α-olefin copolymer and a base oil other than that. The content of the ethylene-α-olefin copolymer based on the total amount of the base oil is not particularly limited but is preferably 60% by mass or more (e.g., 65 to 95% by mass) and more preferably 70% by mass or more (e.g., 70 to 90% by mass).

As the base oil other than the ethylene-α-olefin copolymer, various synthetic oils are usable such as synthetic hydrocarbon oils (e.g., a poly-α-olefin such as poly(1-decene), and polybutene), ether-based synthetic oils (e.g., alkyldiphenyl ether and polypropylene glycol), ester-based synthetic oils (e.g., diester and polyol ester), silicone oils, and fluorinated oils. One of these base oils may be used or two or more of them may be used in combination with each other. Among these base oils, the synthetic hydrocarbon oils are preferred, and the poly-α-olefin (PAO) such as poly(1-decene) is more preferred.

The kinetic viscosity of the base oil other than the ethylene-α-olefin copolymer at 40° C. is not particularly limited but is selectable from the range of 10 to 200 $mm^2/s$, for example, and is preferably 15 to 100 $mm^2/s$ and more preferably 19 to 50 $mm^2/s$.

In view of the lubricity, a certain oil film thickness needs to be ensured and the kinetic viscosity of the base oil as a whole is desirably high. Moreover, in view of the frequency dependency too, the complex modulus needs to be high and the kinetic viscosity of the base oil as a whole is desirably high. Thus, the kinetic viscosity of the base oil at 40° C. needs to be at least 2,000 $mm^2/s$ or more and is preferably 2,200 $mm^2/s$ or more, more preferably 2,400 $mm^2/s$ or more, and particularly preferably 2,600 $mm^2/s$ or more.

On the other hand, in view of the low-torque performance at low temperature, the kinetic viscosity of the base oil as a whole is desirably small. Thus, the kinetic viscosity of the base oil at 40° C. is at least 6,000 $mm^2/s$ or less and is preferably 5,500 $mm^2/s$ or less and particularly preferably 5,400 $mm^2/s$ or less.

The content of the base oil based on the total amount of the grease composition is not particularly limited but is selectable from the range of 50 to 99% by mass, for example, and is preferably 70 to 98% by mass, more preferably 80 to 95% by mass, and particularly preferably 89 to 93% by mass.

(Thickener)

In the present invention, every thickener is usable. Examples of the thickener include soap thickeners, urea thickeners (e.g., aliphatic diurea, alicyclic diurea, and aromatic diurea), inorganic thickeners (e.g., organophilic clay and silica), organic thickeners (e.g., polytetrafluoroethylene), and the like. One of these thickeners can be used or two or more of them can be used in combination with each other. Among these thickeners, the soap thickeners and the aliphatic diurea thickeners (e.g., a reaction product of 4,4'-diphenylmethane diisocyanate and aliphatic amine (such as octylamine and/or stearylamine)) are preferred, and the soap thickeners are particularly preferred.

The soap thickeners contain an alkali metal salt (such as lithium salt or sodium salt) or an alkaline earth metal salt (such as calcium salt) of a fatty acid as the base. A preferred soap thickener is a lithium soap thickener containing a lithium salt of a fatty acid as the base.

Examples of the lithium soap thickener include a lithium soap (e.g., a lithium salt of a higher fatty acid (e.g., lithium stearate or lithium hydroxystearate)), a lithium complex soap (e.g., a complex salt of a lithium salt of a higher fatty acid (e.g., lithium stearate or lithium hydroxystearate) and a lithium salt of a diprotic acid), and the like.

Among these lithium soap thickeners, lithium stearate and lithium hydroxystearate are preferred and lithium hydroxystearate is particularly preferred. As compared to lithium stearate, lithium hydroxystearate can achieve the same penetration in a smaller amount. Accordingly, lithium hydroxystearate can reduce the resistance to stirring originating from the thickener and therefore provide good low-torque performance.

The content of the thickener based on the total amount of the grease composition is not particularly limited but is selectable from the range of 10% by mass and less, for example, and is preferably 1 to 8% by mass and more preferably 2 to 5% by mass.

(Additive)

(A) Polar Wax

In the present invention, in view of satisfying the compatibility with a dust cover (e.g., chloroprene rubber dust cover) in addition to the lubricity, the additive contains at least a polar wax. Note that if no wax is mixed in the grease, composition or a non-polar wax is contained in the grease composition, the plasticizer in the dust cover material will be eluted into the grease, which will make the dust cover shrink and harden. Thus, it will be impossible to sufficiently satisfy the compatibility with the dust cover.

The polar wax is not particularly limited but examples thereof include a monoamide wax (a wax having a single amide bond), an ester wax (a wax having at least one ester bond), a ketone wax, an oxidized polyethylene wax, and combinations thereof. Among these waxes, the monoamide wax and/or the ester wax are/is preferred. In the case of using the combination of the monoamide wax and the ester wax, the ratio (mass ratio) between the monoamide wax and the ester wax is selectable from the range of 1/99 to 99/1, for example, and is preferably 10/90 to 90/10 and more preferably 20/80 to 80/20.

Examples of the monoamide wax include higher fatty acid amides, e.g., stearic acid amide, oleic acid amide, combinations thereof, and the like. Examples of the ester wax include higher fatty acid esters, e.g., montanic acid ester, hydrogenated castor oil, and the like. Among the polar waxes, at least one selected from stearic acid amide and hydrogenated castor oil is preferred, and hydrogenated castor oil is particularly preferred.

The content of the polar wax based on the total amount of the grease composition (the total content in the case of using a plurality of polar waxes) is not particularly limited but is selectable from the range of 1 to 20% by mass, for example, and is preferably 2 to 15% by mass and more preferably 3 to 10% by mass (e.g., 5 to 10% by mass). If the content of the polar wax is too small, the amount of wax penetrating into the dust cover material will insufficient. This may lead to a failure to suppress shrinkage of the dust cover. Also, if the content of the polar wax is too large, the grease will be hard. This may deteriorate the low-torque performance at low temperature.

(B) Other Additives

The grease composition of the present invention may further contain other additives in addition to the polar wax. The other additives are not particularly limited as long as they do not block the effects of the present invention, and examples thereof include a solid lubricant, an antioxidant, a rust inhibitor, a metal corrosion inhibitor, an oiliness agent, an antiwear agent, an extreme pressure agent, and the like. One of these additives may be used or two or more of them may be used in combination with each other. Among these additives, the solid lubricant and the antioxidant are preferred.

(B1) Solid Lubricant

Mixing the solid lubricant in the grease composition can further improve the lubricity. As the solid lubricant, various solid lubricants such as fluorine-based, sulfur-based, and carbon-based solid lubricants are usable. Specifically, examples include polytetrafluoroethylene, melamine cyanurate, molybdenum disulfide, graphite, and the like. One of these solid lubricants may be used or two or more of them may be used in combination with each other. Among these solid lubricants, at least one selected from polytetrafluoroethylene and melamine cyanurate is preferred, and a combination of polytetrafluoroethylene and melamine cyanurate is particularly preferred. In this combination, the ratio (mass ratio) between the polytetrafluoroethylene and the melamine cyanurate is selectable from the range of 30/70 to 30/70 (=former/latter), for example, and 40/60 to 60/40 (e.g., 50/50 to 60/40) is preferred.

The content of the solid lubricant based on the total amount of the grease composition (the total content in the case of using a plurality of solid lubricants) is not particularly limited but is selectable from the range of 0.1 to 10% by mass, for example, and is preferably 0.5 to 8% by mass and more preferably 1 to 5% by mass.

(B2) Antioxidant

As the antioxidant, components known to suppress oxidative deterioration of grease such as a phenol-based antioxidant and an amine-based antioxidant are usable, for example. One of the phenol-based antioxidant and the amine-based antioxidant may be used but they are preferably used in combination with each other. In this combination, the ratio (mass ratio) between the phenol-based antioxidant and the amine-based antioxidant is selectable from the range of 30/70 to 30/70 (=former/latter), for example, and 40/60 to 60/40 (e.g., 50/50 to 60/40) is preferred.

As the phenol-based antioxidant, octadecyl-3-(3,5-di-t-butyl-4-hydroxyphenyl)propionate is preferred. As the amine-based antioxidant, alkyldiphenyl amine is preferred.

The content of the antioxidant based on the total amount of the grease composition (the total content in the case of using a plurality of antioxidants) is not particularly limited but is selectable from the range of 0.1 to 10% by mass, for example, and is preferably 0.5 to 8% by mass and more preferably 1 to 5% by mass.

(Penetration)

The worked penetration of the grease composition of the present invention is 250 to 350, for example, and is preferably 280 to 320 (e.g., 300 to 320). Note that the worked penetration is a value measured immediately after mixing the sample back and forth 60 times with a specified mixer, as defined in JIS K 2220.

[Ball Joint]

The ball joint has a structure in which the above grease composition is sealed.

More specifically, the ball joint includes, for example, as illustrated in FIG. 1: a ball stud 1 having a stud portion extending in the axial direction and a ball portion joined to the stud portion in the axial direction through a thinner portion (link portion); a ball seat 2 holding the ball portion of the ball stud rotatably and swingably; a tubular case 3 with a closed bottom housing the ball seat; and a dust cover 4 mounted on a cover groove around the opening end of the case.

The material of the ball stud 1 is a metal, and the type of metal includes steel. The material of the ball seat 2 is a resin or an elastomer. The type of resin includes: commodity resins such as polyethylene (PE); engineering plastics such as polyacetal (POM), polyamide (PA), and polycarbonate (PBT); super engineering plastics such as polyamide-imide (PAI), polyether ether ketone (PEEK), and polyphenylene sulfide (PPS); and the like. The type of elastomer includes polyester elastomer, polyurethane elastomer, and the like.

In the above ball joint, the ball stud 1 and the ball seat 2 slide relative to each other. Since the material of the ball stud 1 is a metal and the material of the ball seat 2 is a resin or an elastomer, the ball seat wears as they slide relative to each other. The above grease composition can be sealed between the ball stud and the ball seat, for example. This sealing can significantly reduce the wear of the ball seat.

The material of the dust cover 4 is a rubber (such as chloroprene rubber) or an elastomer (such as polyurethane elastomer). If a conventional grease composition is sealed in the dust cover, the dust cover will swell or shrink and break. This will pose a problem in that foreign matters such as dust and muddy water from outside will enter the slide region. However, the grease composition of the present invention can suppress the swelling or shrinkage of the dust cover, and can therefore be sealed in the dust cover to supply the grease at the slide region and to hold the shape of the cover.

Note that the structure of the ball joint is not limited to the structure illustrated in FIG. 1. Those skilled in the art various can make various design changes. For example, the ball seat can also be formed of two pieces (a bearing seat and a cushion seat). The grease composition of the present invention is applicable to ball joints of various structures.

As described above, the grease composition of the present invention can suppress the wear of a ball seat at a slide region and also has excellent compatibility with a dust cover, and is therefore preferably usable as a grease composition for a ball joint. Also, the grease composition of the present invention has excellent low-torque performance at low temperature. Further, the grease composition of the present invention can satisfy the frequency dependency. The grease composition of the present invention is therefore preferably usable as a grease composition for use with a ball joint for an automobile.

EXAMPLES

The present invention will be described below in detail based on examples. However, the present invention is not limited by these examples.

<Test Grease>

1. Lithium Soap Grease

Examples 1 to 4 and 6 to 8 and Comparative Examples 1 and 2

In each of the base oils described in table 1 and table 2, a lithium soap was mixed, heated, and dissolved, and then cooled to obtain a base grease. A wax was mixed in a predetermined amount in the base oil, and the resultant mixture was added and mixed well in the base grease. Further, predetermined amounts of antioxidants were added and mixed well in the base grease. Lastly, the base grease was kneaded with a three-roll mill to produce a grease composition with a worked penetration of 300 (JIS K 2220).

Example 9

In the base oil described in table 1, the lithium soap was mixed, heated, and dissolved, and then cooled to obtain a base grease. A wax was mixed in a predetermined amount in the base oil, and the resultant mixture was added and mixed well in the base grease. Further, predetermined amounts of solid lubricants and the predetermined amounts of the antioxidants were added and mixed well in the base grease. Lastly, the base grease was kneaded with a three-roll mill to produce a grease composition with a worked penetration of 300 (JIS K 2220).

2. Urea Grease

Example 5

In the base oil described in table 1, diphenylmethane diisocyanate and amines (octylamine and stearylamine) were reacted with each other, heated, and cooled to obtain a base grease. A wax was mixed in a predetermined amount in the base oil, and the resultant mixture was added and mixed well in the base grease. Further, the predetermined amounts of the antioxidants were added and mixed well in the base grease. Lastly, the base grease was kneaded with a three-roll mill to produce a grease composition with a worked penetration of 300 (JIS K 2220).

<Resin Lubricity>

Each test grease was applied onto a metal (AISI 52100 steel) disc, and a slide member (polyacetal) was caused to slide on the disc under the following test conditions to conduct an SRV test (complying with ASTM D7420-10). The resin lubricity of each test grease was evaluated based on the following determination criteria.

(Test Conditions) Temperature: 50° C., Amplitude: 0.1 mm, Frequency: 50 Hz, Duration: 12 h Load: Firstly at 50 N for 30 seconds as a pre-conditioning test and then raised to 1500 N.

(Determination Criteria) A wear amount of 1.0 mg or less was determined as a pass and a wear amount of more than 1.0 mg was determined as a fail.

0.4 mg or less: ◎ (pass)

More than 0.4 mg and 1.0 mg or less: ○ (pass)

More than 1.0 mg: × (fail)

<Compatibility with Dust Cover (CR Material Compatibility)>

Each test grease was subjected to a boot-material immersion test under the following test conditions. The change in volume of a CR (chloroprene rubber) material before and after the immersion was measured, and the compatibility with the dust cover was evaluated based on the following determination criteria.

(Test Conditions) Test Piece: CR rubber, Temperature: 120° C., Duration: 168 h (Determination Criteria) Any test grease with a rate of change in volume within ±15.0% was determined as a pass and any test grease with a rate of change in volume outside ±15.0% was determined as a fail.

Within ±10.0%: ◎ (pass)

Outside ±10.0 and within ±15.0%: ○ (pass)

Outside ±15.0%: × (fail)

<Low-Torque Performance at Low Temperature>

Each test grease was subjected to a low-temperature torque test (JIS K 2220 18.) under the following test condition, and the low-torque performance at a low temperature was evaluated based on the following determination criteria.

(Test Condition) Temperature: −30° C.

(Determination Criteria) A start torque of 500 mN·m or less and a rotation torque of 300 mN·m or less were determined as a pass, while a start torque of more than 500 mN·m and a rotation torque of more than 300 mN·m were determined as a fail.

A start torque of 400 mN·m or less and a rotation torque of 240 mN·m or less: ◎ (pass)

A start torque of more than 400 mN·m and 500 mN·m or less and a rotation torque of more than 240 mN·m and 300 mN·m or less: ○ (pass)

A start torque of more than 500 mN·m and a rotation torque of more than 300 mN·m: × (fail)

TABLE 1

| | | Ex. 1 | Ex. 2 | Ex. 3 | Ex. 4 | Ex. 5 |
|---|---|---|---|---|---|---|
| Thickener | Lithium hydroxystearate | 2 | 2 | 2 | 2 | — |
| (% by mass in grease) | Aliphatic diurea | — | — | — | — | 6 |

TABLE 1-continued

| | | | | | | |
|---|---|---|---|---|---|---|
| Base oil (% by mass of base oil based on total amount of base oil (100%)) | Ethylene-α-olefin copolymer 380 $mm^2/s$ @ 40° C. | — | — | — | — | — |
| | Ethylene-α-olefin copolymer 9,850 $mm^2/s$@40° C. | 70 | 75 | 90 | 75 | 75 |
| | Ethylene-α-olefin copolymer 45,000 $mm^2/s$@40° C. | — | — | — | — | — |
| | Poly-α-olefin 19 $mm^2/s$@40° C. | 30 | 25 | 10 | — | 25 |
| | Poly-α-olefin 1,240 $mm^2/s$@40° C. | — | — | — | — | — |
| | Polybutene 19.4 $mm^2/s$@40° C. | — | — | — | 25 | — |
| | Polybutene 160,000 $mm^2/s$@40° C. | — | — | — | — | — |
| Base oil kinetic viscosity@40° C. $mm^2/s$ | | 2,200 | 2,600 | 5,400 | 3,000 | 2,600 |
| Additive (% by mass in grease) | Stearic acid amide | — | — | — | — | — |
| | Hydrogenated castor oil | 5 | 5 | 5 | 5 | 5 |
| | Polyethylene wax | — | — | — | — | — |
| | PTFE (polytetrafluoroethylene) | — | — | — | — | — |
| | MCA (melamine cyanurate) | — | — | — | — | — |
| | Octadecyl-3-(3,5-di-t-butyl-4-hydroxyphenyl)propionate | 1 | 1 | 1 | 1 | 1 |
| | Alkyl diphenyl amine | 1 | 1 | 1 | 1 | 1 |
| Resin lubricity | SRV test evaluation | ○ | ○ | ◎ | ○ | ○ |
| Compatibility with dust cover (CR material compatibility) | Boot-material immersion test evaluation | ◎ | ◎ | ◎ | ◎ | ◎ |
| Low-torque performance at low temperature | Low-temperature torque test evaluation | ◎ | ◎ | ○ | ○ | ◎ |

| | | Ex. 6 | Ex. 7 | Ex. 8 | Ex. 9 |
|---|---|---|---|---|---|
| Thickener (% by mass in grease) | Lithium hydroxystearate | 2 | 2 | 2 | 2 |
| | Aliphatic diurea | — | — | — | — |
| Base oil (% by mass of base oil based on total amount of base oil (100%)) | Ethylene-α-olefin copolymer 380 $mm^2/s$ @ 40° C. | — | — | — | — |
| | Ethylene-α-olefin copolymer 9,850 $mm^2/s$@40° C. | 75 | 75 | 75 | 75 |
| | Ethylene-α-olefin copolymer 45,000 $mm^2/s$@40° C. | — | — | — | — |
| | Poly-α-olefin 19 $mm^2/s$@40° C. | 25 | 25 | 25 | 25 |
| | Poly-α-olefin 1,240 $mm^2/s$@40° C. | — | — | — | — |
| | Polybutene 19.4 $mm^2/s$@40° C. | — | — | — | — |
| | Polybutene 160,000 $mm^2/s$@40° C. | — | — | — | — |
| Base oil kinetic viscosity@40° C. $mm^2/s$ | | 2,600 | 2,600 | 2,600 | 2,600 |
| Additive (% by mass in grease) | Stearic acid amide | 5 | — | — | — |
| | Hydrogenated castor oil | — | 1 | 10 | 5 |
| | Polyethylene wax | — | — | — | — |
| | PTFE (polytetrafluoroethylene) | — | — | — | 2.5 |
| | MCA (melamine cyanurate) | — | — | — | 2.5 |
| | Octadecyl-3-(3,5-di-t-butyl-4-hydroxyphenyl)propionate | 1 | 1 | 1 | 1 |
| | Alkyl diphenyl amine | 1 | 1 | 1 | 1 |
| Resin lubricity | SRV test evaluation | ○ | ○ | ○ | ◎ |
| Compatibility with dust cover (CR material compatibility) | Boot-material immersion test evaluation | ◎ | ○ | ◎ | ◎ |
| Low-torque performance at low temperature | Low-temperature torque test evaluation | ◎ | ◎ | ○ | ◎ |

TABLE 2

| | | Comp. Ex. 1 | Comp. Ex. 2 |
|---|---|---|---|
| Thickener (% by mass in grease) | Lithium hydroxystearate | 2 | 2 |
| | Aliphatic diurea | — | — |
| Base oil (% by mass of base oil based on total amount of base oil (100%)) | Ethylene-α-olefin copolymer 380 $mm^2/s$@40° C. | — | — |
| | Ethylene-α-olefin copolymer 9,850 $mm^2/s$@40° C. | 60 | 75 |
| | Ethylene-α-olefin copolymer 45,000 $mm^2/s$@40° C. | — | — |

TABLE 2-continued

| | | Comp. Ex. 1 | Comp. Ex. 2 |
|---|---|---|---|
| | Poly-α-olefin 19 $mm^2/s$@40° C. | 40 | 25 |
| | Poly-α-olefin 1,240 $mm^2/s$@40° C. | — | — |
| | Polybutene 19.4 $mm^2/s$@40° C. | — | — |
| | Polybutene 160,000 $mm^2/s$@40° C. | — | — |
| Base oil kinetic viscosity@40° C. $mm^2/s$ | | 1,200 | 2,600 |
| Additive (% by mass in grease) | Stearic acid amide | — | — |
| | Hydrogenated castor oil | 5 | — |
| | Polyethylene wax | — | 5 |
| | PTFE (polytetrafluoroethylene) | — | — |
| | MCA (melamine cyanurate) | — | — |
| | Octadecyl-3-(3,5-di-t-butyl-4-hydroxyphenyl)propionate | 1 | 1 |
| | Alkyl diphenyl amine | 1 | 1 |
| Resin lubricity | SRV test evaluation | X | ◎ |
| Compatibility with dust cover (CR material compatibility) | Boot-material immersion test evaluation | ◎ | X |
| Low-torque performance at low temperature | Low-temperature torque test evaluation | ◎ | ◎ |

As is clear from table 1 and table 2, the grease compositions of the examples are superior to the grease compositions of the comparative examples in resin lubricity and compatibility with the duct cover. Also, the grease compositions of the examples satisfy the low-torque performance at low temperature as well.

What is claimed is:

1. A grease composition for a ball joint comprising:

a base oil;

a thickener; and an additive, wherein the base oil is a combination of an ethylene-α-olefin copolymer having a kinetic viscosity at 40° C. of 7,000 to 15,000 $mm^2/s$ and poly-α-olefin having a kinetic viscosity at 40° C. of 19 to 50 $mm^2/s$, the base oil has a kinetic viscosity at 40° C. of 2,200 to 5,400 $mm^2/5$, and a content of the ethylene-α-olefin copolymer is 70% by mass or more and 90% by mass or less based on a total amount of the base oil, the additive contains as a polar wax hydrogenated castor oil, the thickener contains a Li soap, a content of the base oil is 80 to 95% by mass based on a total amount of the grease composition, a content of the thickener is 1 to 5% by mass based on the total amount of the grease composition, a content of the polar wax is 1 to 10% by mass based on the total amount of the grease composition, and a content of additive except for the polar wax is 18% by mass or less based on the total amount of the grease composition.

2. The grease composition according to claim 1, wherein the content of the polar wax is 3 to 10% by mass based on the total amount of the grease composition.

3. The grease composition according to claim 1, wherein the additive further contains at least one solid lubricant selected from polytetrafluoroethylene and melamine cyanurate.

4. The grease composition according to claim 1, wherein the additive further contains polytetrafluoroethylene and melamine cyanurate at a mass ratio of 30/70 to 70/30.

5. The grease composition according to claim 1, wherein the thickener is lithium hydroxystearate.

6. The grease composition according to claim 1, wherein the content of the solid lubricant is 0.1 to 10% by mass based on a total amount of the grease composition.

* * * * *